United States Patent [19]

Muldery et al.

[11] Patent Number: 4,614,325

[45] Date of Patent: Sep. 30, 1986

[54] APPARATUS FOR MOLDING PANELS, PARTICULARLY OF CEMENTITIOUS MATERIAL

[75] Inventors: Hendrikus Muldery, 25 Lennox Street, Union Extension 1; Frank V. van der Struys, both of Germiston; Heinz Schubert, Alberton, all of South Africa

[73] Assignee: Henrikus Muldery, Germiston, South Africa

[21] Appl. No.: 325,376

[22] Filed: Nov. 27, 1981

[51] Int. Cl.[4] ..... B28B 7/04; B28B 7/24

[52] U.S. Cl. ..... 249/120; 249/129; 249/131; 249/137; 249/139; 249/155; 249/166

[58] Field of Search ..... 249/129, 161, 166, 170, 249/185, 120, 137, 139, 159, 131, 155

[56] References Cited

U.S. PATENT DOCUMENTS

| | | | |
|---|---|---|---|
| 1,760,282 | 5/1930 | Pedersen | 249/129 |
| 2,763,909 | 9/1956 | Guimont | 249/129 |
| 3,360,231 | 12/1967 | Van Hezik | 249/129 |
| 3,844,524 | 10/1974 | Fisher | 249/129 |
| 3,954,377 | 5/1976 | Scholz | 249/112 |
| 4,067,941 | 1/1978 | Gandelli | 249/129 |
| 4,135,695 | 1/1979 | Capdevila | 249/129 |
| 4,191,521 | 3/1980 | Muldery | 249/129 |

FOREIGN PATENT DOCUMENTS 185250 6/1965 U.S.S.R. .

*Primary Examiner*—Jan Silbaugh

*Attorney, Agent, or Firm*—Finnegan, Henderson, Farabow, Garrett & Dunner

[57] ABSTRACT

A battery type mold assembly in which simple upwardly extending mold members having relief patterns on their major mold surfaces are pivotally mounted on a frame at the lower ends so as to be movable between a closed position in which a mold cavity is formed and an open position in which there is provided for the removal of a molded article therefrom. The assembly is characterized by the presence of carrier members which are, at least initially, adjustable relative to each other and the carrier members are pivotally connected to the mold members.

6 Claims, 3 Drawing Figures

APPARATUS FOR MOLDING PANELS, PARTICULARLY OF CEMENTITIOUS MATERIAL

BACKGROUND TO THE INVENTION

This invention relates to battery type apparatus for molding panels from a settable material and, in particular, but not exclusively, cementitious material and most particularly reinforced concrete panels for precast walls or the like.

Often apparatus for molding precast concrete panels comprises a flat mold in which case a relief design or pattern can only practically be provided on the underside during casting i.e on one operative surface of the panel. The other surface is therefore left without a pattern and can tend to be somewhat unattractive.

In order to overcome this disadvantage a number of different proposals have been put forward to mold the panels in an "edge-on" orientation between a pair of relatively movable mold members, each of which provides a relief patterned surface on an article molded in the apparatus.

Some fairly sophisticated apparatus has been developed for the purpose of molding panels in this manner and, many of these are somewhat complicated or alternatively expensive, and possibly both. In the case of the extremely simple types of mold assemblies made to effect molding of a plurality of panels simultaneously, the mold members are simply pivoted to a support member at the lower end as for example in Russian Patent No. 185250.

Such a simple arrangement, while being desirable from the simplicity of construction point of view, does lead to difficulties in the assembly of the components together in that it is usually difficult to locate the pivot points of the individual mold members sufficiently accurately. One of the reasons for this is that the mold surface is defined by suitable elastomeric material such as certain silicon rubbers, and the required spacing of the mold members in their closed position cannot be predicted with great certainty. Also, any inaccuracy in the location of one pivot point is cumulative relative to other pivot points of mold members in the same assembly or battery.

It is accordingly the object of this invention to provide a simple type of mold assembly for molding panels in an "on-edge" orientation in which the location of the pivot points is greatly facilitated to thereby provide an effective yet extremely simple mold assembly.

BRIEF SUMMARY OF THE INVENTION

In accordance with this invention there is provided a mold assembly of the general type described and comprising at least three mold members supported on a frame in a generally upwardly extending direction and wherein at least two of the mold members are pivotally movable between a position in which they each define, together with another mold member, a mold cavity for defining a panel and a position in which such mold cavity is open sufficiently for removal of a molded article therefrom, the assembly being characterised in that the pivot points are each associated with a carrier member which, at least prior to final location of the carrier member relative to a supporting frame member therefor, are adjustable in position to vary the spacing between the pivot axes and the carrier members are each locked relative to said frame to fix the spacing of said axes.

Further features of the invention provide for the carrier members to be permanently locked to said frame such as by welding for example or, alternatively, for the carrier members to be releasably locked to said frame member; for the frame member to have a slotted configuration wherein the slots extend substantially horizontally and the carrier members are adjustable in position relative to said slots; for the assembly to comprise a whole series of mold members pivotally mounted on carrier members and whereof some are movable about their pivots in one direction and some about pivots in an opposite direction with a central mold member being fixed in its vertical orientation relative to the supporting frame member therefor; and for the mold members to be adapted to define elongated precast concrete wall panels with the length of such panels preferably extending in a horizontal direction.

Conveniently the supporting frame can comprise a pair of spaced, parallel frame members which can assume any suitable cross-sectional shape but which are conveniently either I-sectioned members or channel-shaped members whereof the web is located in a vertical orientation. In either case one flange of the frame member is provided with one or more elongated slots directed in the direction of the length thereof and receiving therein a part of, or a part associated with, a carrier for a pivotal mounting of a mold member. The carriers are, at least at the assembly stage of the apparatus, movable longitudinally in the slots so that the positions of the axes of the pivotal mountings relative to the frame members and also relative to each other can be adjusted as required. After proper adjustment the carriers can be either permanently or temporarily fixed relative to the frame members.

BRIEF DESCRIPTION OF THE DRAWINGS

In order that the invention may be more fully understood one embodiment thereof will now be described with reference to the accompanying drawings in which.

DETAILED DESCRIPTION OF ILLUSTRATED EMBODIMENT OF THE INVENTION

Figure 1:
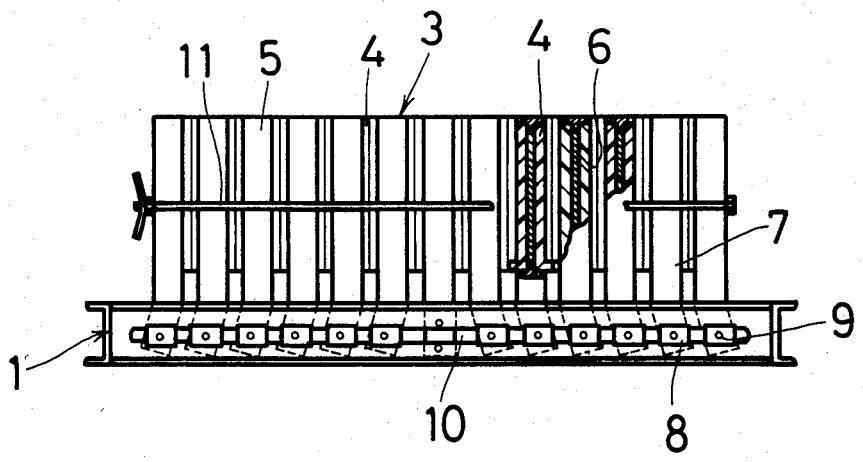
FIG. 1 is a side elevation of a mold assembly according to the invention.
Figure 2:
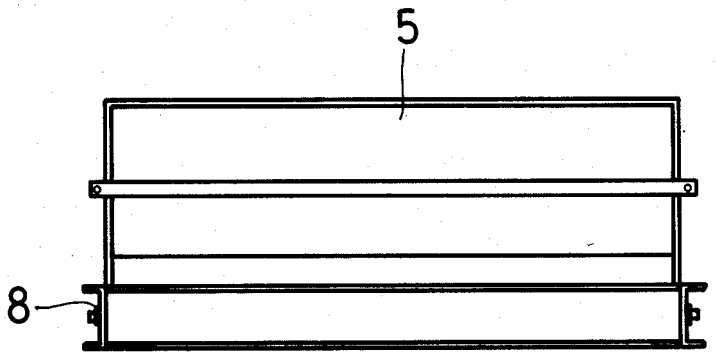
FIG. 2 is an end elevation thereof.
Figure 3:
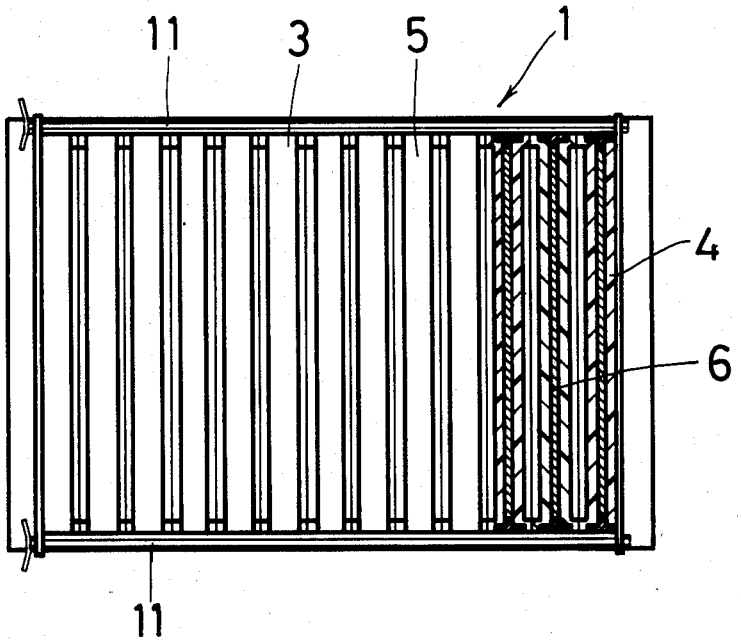
FIG. 3 is a plan view of the mold assembly.

In this embodiment of the invention a rectangular frame 1 is defined by four lengths of channel-sections located on edge i.e. with the web thereof in a vertical plane in the operative position. The frame is rectangular and has a width chosen to provide for pivotal mounting of mold members dimensioned to produce precast concrete wall panels with the length of the panel extending in a horizontal direction. The length of the frame, on the other hand, is chosen to provide for the pivotal mounting of the required number of mold members to define the required number of mold cavities in use.

Secured to the two side frame members is a centrally located transverse fixed mold member 3 which, in the operative orientation is adapted to be vertical. The mold member has, on each side thereof, the required elastomeric mold defining material 4.

A series of pivotally mounted mold members 5 is provided on each side of the fixed mold member so that the nearest pivotally mounted mold member defines with the fixed mold member a first mold cavity on each side thereof, and each subsequent pivotally mounted mold member defines, with the adjacent pivotally mounted mold member further mold cavities. Each of the mold members has, on both sides thereof, the elastomeric mold defining material 4 which is adapted to form a relief pattern in each major surface of each molded panel.

Conveniently each mold member can be defined by a perforated metal plate 6 through which the elastomeric material is molded and cured so that the perforated metal plate simply supports the elastomeric mold defining material.

Each mold member has side frame members 7 which extend down well beyond the lower edge of the mold defining portion thereof and which are inclined somewhat away from the central mold member. The lower ends of these extended sides are pivotally attached to a carrier member 8 through pivots 9 which can be in the form of simple stub axles passing through holes in the side members. These carrier members are adjustable along the lengths of slots 10 provided in the webs of the frame members and each can be fixed, at least temporarily, in any required position by means of suitable bolts passing through the carrier members and causing frictional engagement thereof with the frame members to take place when tightened.

It will be readily understood that the mold members are prefabricated and, accordingly differences and large tolerances obtained in their manufacture can be accommodated by suitably adjusting the carrier members in position on the frame members. In this manner highly effective relative location of the mold members can be achieved both concerning the pivotally mounted mold members relative to each other and also relative to the central fixed mold member.

Once all the carrier members have been located relative to the frame members in the required position and, if required, the mold assembly can in fact have been tested, the carrier members can be permanently fixed relative to the frame members, for example, by welding.

In use the mold members can all be pivoted towards the central fixed mold member in order to close the mold cavities defined thereby. They can be simply held in this position by means of tie-rods 11 having suitable wing nuts at their ends for clamping the mold members together. The mold cavities can then be filled with cementitious mix, optionally with reinforcing having been located in the mold cavities previously and panels can be molded in the normal way. Clearly the cementitious material can be vibrated in order to exclude air insofar as is possible and to compact the aggregate of the cementitious material. Also, the upper edges of the molded panels can be smoothed off at the level of the tops of the molded cavities.

Once the panels have dried sufficiently (complete curing is not necessary as is known in the art) the mold cavities can be opened one by one starting with the outermost cavities at each end of the mold assembly. Once the molded panels have been removed the mold can be cleaned and prepared for a further cycle of the process which can then be repeated as required.

It will be understood that numerous variations may be made to the above described embodiment of the invention without departing from the scope hereof. In particular the means whereby the carriers are temporarily or permanently fixed relative to the frame members can be varied as required and, indeed, temporary fixing may be preferred in many cases. This would have the advantage that if one mold member had to be replaced readjustment of all the mold members could take place insofar as is necessary. Alternatively, in order to obviate the danger of fasteners or the like becoming ineffective, tack welding of the carrier members to the frame members could be achieved and such welds could be broken when necessary.

It will be understood that the invention provides a mold assembly whereof the mould members can be easily and accurately located relative to each other and the difficulties of the prior art are obviated.

What we claim as new and desire to secure by Letters Patent is:

1. In a mold assembly for molding a plurality of panels comprising at least three mold members supported on a generally horizontal frame and extending generally upwardly thereof, each of said mold members being cooperable with adjacent mold members to define mold cavities, at least two of said mold members being pivotally connected to carriers on said frame at locations below said mold cavities for movement about substantially parallel, horizontal pivotal axes from a closed operative position whereby panels can be molded in said cavities, to an open position whereby molded panels can be removed from said mold cavities; the improvement wherein said carriers are adjustable on said frame horizontally relative to each other to vary the spacing between the pivotal axes of said mold members.

2. A mold assembly as claimed in claim 1, said carriers and said frame being constructed so that said carriers can be permanently locked to said frame in selected adjusted positions.

3. A mold assembly as claimed in claim 2, said carriers being releasable from said frame to facilitate repair and readjustment of the position of said pivotal axes.

4. A mold assembly as claimed in claim 1, said frame being provided with a plurality of horizontal slots, said carriers having portions received in said slots and movable longitudinally thereof.

5. A mold assembly as claimed in claim 1, including a central mold member fixed to said frame, and a plurality of mold members pivotally connected to carriers on said frame at locations below said mold cavities on opposite sides of said fixed mold member, the pivotal mold members on one side of said fixed mold member being pivotal about their pivotal axes in one direction, the pivotal mold members on the other side of fixed mold member being pivotal about their pivotal axes in the other direction relative to the fixed mold member.

6. A mold assembly as claimed in claim 1, said mold cavity being shaped to form elongated precast concrete wall panels.

* * * * *